US009475599B2

(12) United States Patent
Liu et al.

(10) Patent No.: US 9,475,599 B2
(45) Date of Patent: Oct. 25, 2016

(54) SHEET MEDIUM STACKING AND BUNDLING DEVICE AND SELF SERVICE EQUIPMENT

(75) Inventors: Heng Liu, Guangzhou (CN); Dong Tan, Guangzhou (CN); En Wu, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 315 days.

(21) Appl. No.: 13/883,996

(22) PCT Filed: Jul. 9, 2012

(86) PCT No.: PCT/CN2012/078349

§ 371 (c)(1),
(2), (4) Date: May 8, 2013

(87) PCT Pub. No.: WO2013/040936

PCT Pub. Date: Mar. 28, 2013

(65) Prior Publication Data

US 2014/0182250 A1 Jul. 3, 2014

(30) Foreign Application Priority Data

Sep. 21, 2011 (CN) ..... 2011 1 0282086

(51) Int. Cl.
*B65B 13/02* (2006.01)
*B65B 13/06* (2006.01)
(Continued)

(52) U.S. Cl.
CPC ..... *B65B 13/02* (2013.01); *B65B 13/06* (2013.01); *B65B 13/20* (2013.01); *B65B 13/32* (2013.01); *B65B 27/08* (2013.01); *B65B 35/36* (2013.01)

(58) Field of Classification Search
CPC ..... B65B 27/08; B65B 27/086; B65B 13/02; B65B 13/06; B65B 13/20; B65B 13/22; B65B 13/32; B65B 61/025; B65B 35/36; G07D 11/0084; B65H 2701/1912; B65H 2301/43824
USPC ..... 100/3, 7, 8, 26, 29, 33 PB; 53/540, 582, 53/589
See application file for complete search history.

(56) References Cited

U.S. PATENT DOCUMENTS 3,483,817 A * 12/1969 Stobb ..... B65B 27/08 100/26
4,711,071 A 12/1987 Kagi
(Continued)

FOREIGN PATENT DOCUMENTS

CN 2423201 3/2001
CN 1396091 2/2003
(Continued)

OTHER PUBLICATIONS

The European Search Report issued on Jan. 20, 2015 for an EP counterpart application.
(Continued)

*Primary Examiner* — Jimmy T Nguyen
(74) *Attorney, Agent, or Firm* — Kilpatrick Townsend & Stockton LLP

(57) ABSTRACT

A processing device of sheet mediums, in particular, a full-automatic stacking and bundling device of notes and the like. The bundling device mainly includes a sheet medium stacking mechanism, a bundling mechanism and a pinching mechanism, the bundling mechanism mainly including a paper belt looping mechanism, a hot-pressing and bonding mechanism and a paper belt cutting-off mechanism. The paper belt looping mechanism includes a guide groove for guiding the paper belt; the head and the tail of the guide groove are connected to form a conveying loop; an opening of the guide groove faces an inner side of the conveying loop; a bottom part of the guide groove is provided with a paper-belt inserting port and at least one paper-belt conveying wheel; and an opening end of a side wall of the guide groove is provided with an elastic guide piece parallel to the bottom part of the guide groove. The stacking and bundling device also includes a pressing mechanism in bundling and a leveling mechanism after bundling. The invention effectively solves the unreliability for forming the loop by the paper belts, the bundling effect is improved, and the notes are bundled tightly and level.

16 Claims, 13 Drawing Sheets

(51) Int. Cl.

| | |
|---|---|
| ***B65B 13/32*** | (2006.01) |
| ***B65B 13/20*** | (2006.01) |
| ***B65B 27/08*** | (2006.01) |
| ***B65B 35/36*** | (2006.01) |

(56) References Cited

U.S. PATENT DOCUMENTS

| | | | | |
|---|---|---|---|---|
| 5,996,314 | A * | 12/1999 | Pennini | B65B 27/08 100/25 |
| 6,513,303 | B2 * | 2/2003 | Neri | B65B 27/086 100/2 |
| 2002/0069613 | A1 * | 6/2002 | Panneri | B65B 13/02 53/399 |
| 2002/0073651 | A1 * | 6/2002 | Muller | B65B 27/08 53/399 |
| 2003/0226455 | A1 | 12/2003 | Dopfer et al. | |
| 2004/0003980 | A1 * | 1/2004 | Hallowell | B65B 27/08 194/206 |
| 2005/0241270 | A1 | 11/2005 | Katsumata | |

FOREIGN PATENT DOCUMENTS

| | | |
|---|---|---|
| CN | 2578234 | 10/2003 |
| CN | 201427677 Y | 3/2010 |
| CN | 101774434 | 7/2010 |
| CN | 101832879 | 9/2010 |
| CN | 101927844 | 12/2010 |
| CN | 101992866 | 3/2011 |
| CN | 102442559 | 5/2012 |
| JP | 2005350073 | 12/2005 |
| WO | 2005081184 | 9/2005 |
| WO | 2010103617 | 9/2010 |

OTHER PUBLICATIONS

The first Office Action issued on Feb. 5, 2015 for a Australian counterpart application.

* cited by examiner

SHEET MEDIUM STACKING AND BUNDLING DEVICE AND SELF SERVICE EQUIPMENT

The present application is the national phase of International Application No. PCT/CN2012/078349, titled "SHEET-LIKE MEDIUM STACKING AND BUNDLING DEVICE AND SELF-SERVICE APPARUTUS", filed on Jul. 9, 2012, which claims the benefit of priority to Chinese Patent Application No. 201110282086.8 titled "SHEET-LIKE MEDIUM STACKING AND BUNDLING DEVICE AND SELF-SERVICE APPARUTUS", filed with the Chinese State Intellectual Property Office on Sep. 21, 2011, the entire disclosure of which is incorporated herein by reference.

FIELD OF THE INVENTION

The present application relates to a sheet-like medium processing device, and particularly to a full-automatic stacking and bundling device for mediums such as banknotes, papers and cheques.

BACKGROUND OF THE INVENTION

With the development and progress of science and technology, some companies that need to handle large amounts of cash normally use a banknote processing machine to implement some actions, such as inspecting, separating by hundred of sheets and bundling, in which one important aspect is to bundle multiple banknotes stacked tidily to a bundle as required by the bank. Currently, the application of an automated teller machine (ATM) has obvious advantages for solving the above problems, such as reduced workload of the owners of banks, reduced number of the tellers and easy arrangement of banking branches; in addition, since the ATM is on duty for 24 hours, it is convenient for customers. However, the application of a large number of the ATM leads to a huge workload of the machine cleaning service. Now, a cash operating process of the ATM usually is as follow, cash replenishing, customer using, machine cleaning, bundling, storing and cash replenishing of the next day. It can be seen that, the work content for the machine cleaning worker mainly includes opening the ATM, taking out the cash box, opening the cash box, taking out remained banknotes, locking the cash box, recovering the ATM, counting the banknotes, bundling, storing and etc. The purpose of the series of working processes is to take out the banknotes in the ATM and store the banknotes after counting and bundling the banknotes. However, the ATM and the cash box must be opened during the above working processes, which affects the security of the ATM and the cash, and during the counting and bundling processes, the workload is huge, the bundling speed is slow, in addition, the bundled banknotes are easy to be separated when the paper tape is broken, and during the bundling process the finger of the worker is easy to be cut by the paper tape.

A lot of human labor is required to stack and bundle a large amount of cash, and currently many manual bundling devices are used in the banking system. The bundling machine can refer to ZL02270702.6. The banknote bundling machine is financial machinery and includes a bracket, and inner and outer tracks, a motor, an electric control device, a driving device, a paper sealing device and a pressing device, which are all mounted on the bracket. In this solution, when the paper tape is pulled back and tightened, the inner track needs to be separated from the outer track in advance so as to facilitate tightening the paper tape, and the banknotes are taken out manually after the bundling. The above bundling machine has a high defect rate in loop-forming of the paper tape, which greatly affects the bundling efficiency. In addition, when using the above bundling device the stacked banknotes need to be placed into the bundling device by a bank operation staff manually to be bundled, and the bundled banknotes need to be flattened manually, therefore, it can not solve the problem of huge workload of the bank operation staff effectively.

SUMMARY OF THE INVENTION

In view of this, an object of the present application is to provide a sheet-like medium stacking and bundling device, which can solve an unreliability of loop-forming of a paper tape and improve the bundling effect by means of the bending deformation of the banknotes during the bundling process, wherein via a flattening mechanism, the bundled banknotes are bundled tightly and flattened so as to meet the bank storage requirements. The present application further provides a technical solution to realize automatic separating, stacking and bundling via a self-service apparatus, which can greatly reduce the labor intensity of bank operators and improve work efficiency of the bank.

The present application provides a sheet-like medium stacking and bundling device, including:

a sheet-like medium stacking mechanism, adapted to stack and tidy sheet-like mediums conveyed one by one;

a bundling mechanism, adapted to bundle a whole stack of stacked and tidied sheet-like mediums; and a clamping and conveying mechanism, adapted to clamp and convey the whole stack of sheet-like mediums stacked and tidied by the sheet-like medium stacking mechanism to the bundling mechanism to be bundled, and clamp a bundled sheet-like medium bundle out of the bundling mechanism;

wherein the bundling mechanism includes a paper tape loop-forming mechanism, a heat and pressure bonding mechanism and a paper tape cutting-off mechanism; the paper tape loop-forming mechanism includes a guiding groove for guiding the paper tape, and a head and a tail of the guiding groove are connected to form a conveying loop; the guiding groove includes a bottom portion, an opening corresponding to the bottom portion, and two corresponding groove side walls extending between the bottom portion and the opening, and the opening faces an inner side of the conveying loop; a paper tape inserting port and at least one paper tape conveying wheel are provided at the bottom portion of the guiding groove; the heat and pressure bonding mechanism and the paper tape cutting-off mechanism are located at the bottom portion of the guiding groove closing to the paper tape inserting port; and a guiding member, having elasticity and parallel to the bottom portion of the guiding groove, is provided at an opening end of the groove side walls.

Preferably, the guiding groove is of an annular track shape.

Further, there are four paper tape conveying wheels respectively distributed at four corners of the guiding groove having the annular track shape.

Preferably, the bundling mechanism further includes a pressing mechanism, which is located at a side of the guiding groove opposite to the clamping and conveying mechanism, and includes a pressing tongue and a pressing plate assembly arranged at opposite sides of sheet-like mediums to be bundled respectively; wherein the pressing tongue extends into the guiding groove, a bonding portion of the loop-forming paper tape is clamped between the pressing tongue and the heat and pressure bonding mechanism, and the pressing plate assembly is driven by a crank and connecting rod mechanism to move towards the pressing tongue to perform a pressing action or move away from the pressing tongue to perform a releasing action.

Further, the pressing plate assembly includes a driving plate driven by a crank and connecting rod mechanism, and an elastic pressing plate is provided on a side of the driving plate facing the pressing tongue.

Further, the pressing tongue is of a substantially triangular shape, the elastic pressing plate is of a substantially "⌂" shape, and the sheet-like mediums between the pressing tongue and the elastic pressing plate are pressed tightly by the pressing tongue and the elastic pressing plate to form deformation.

Preferably, the bundling mechanism further includes a flattening mechanism, which is located at a side of the guiding groove close to the clamping and conveying mechanism, and includes a supporting mechanism and a flapping mechanism arranged at opposite sides of the sheet-like mediums to be bundled.

Further, the supporting mechanism is driven by a scissor-type mechanism to form a high position and a low position.

Further, the flapping mechanism is driven by a crank-slider mechanism to perform reciprocating movement towards the supporting mechanism, so as to flap and flatten the sheet-like mediums.

The present application also provides a self-service apparatus including a user operating portion, a sheet-like medium receiving portion, a sheet-like medium conveying portion and a sheet-like medium stacking and bundling device, wherein the sheet-like medium stacking and bundling device includes:

a sheet-like medium stacking mechanism, adapted to stack and tidy sheet-like mediums conveyed one by one;

a bundling mechanism, adapted to bundle a whole stack of stacked and tidied sheet-like mediums; and a clamping and conveying mechanism, adapted to clamp and convey the whole stack of sheet-like mediums stacked and tidied by the sheet-like medium stacking mechanism to the bundling mechanism to be bundled, and clamp a bundled sheet-like medium bundle out of the bundling mechanism:

wherein the bundling mechanism includes a paper tape loop-forming mechanism, a heat and pressure bonding mechanism and a paper tape cutting-off mechanism; the paper tape loop-forming mechanism includes a guiding groove for guiding the paper tape, and a head and a tail of the guiding groove are connected to form a conveying loop; the guiding groove includes a bottom portion, an opening corresponding to the bottom portion, and two corresponding groove side walls extending between the bottom portion and the opening, and the opening faces an inner side of the conveying loop; a paper tape inserting port and at least one paper tape conveying wheel are provided at the bottom portion of the guiding groove; the heat and pressure bonding mechanism and the paper tape cutting-off mechanism are located at the bottom portion of the guiding groove closing to the paper tape inserting port; and a guiding member, having elasticity and parallel to the bottom portion of the guiding groove, is provided at an opening end of the groove side walls.

Preferably, the bundling mechanism further includes a pressing mechanism, which is located at a side of the guiding groove opposite to the clamping and conveying mechanism, and includes a pressing tongue and a pressing plate assembly arranged at opposite sides of the sheet-like mediums to be bundled respectively; wherein the pressing tongue extends into the guiding groove, a bonding portion of the loop-forming paper tape is clamped between the pressing tongue and the heat and pressure bonding mechanism, and the pressing plate assembly is driven by a crank and connecting rod mechanism to move towards the pressing tongue to perform a pressing action or move away from the pressing tongue to perform a releasing action.

Preferably, the bundling mechanism further includes a flattening mechanism, which is located at a side of the guiding groove close to the clamping and conveying mechanism, and includes a supporting mechanism and a flapping mechanism arranged at opposite sides of the sheet-like mediums to be bundled.

Compared with the prior art, the technical solutions provided by the present application has the following advantages.

The sheet-like medium stacking and bundling device according to the present application can effectively solve a problem of unreliability of the loop-forming of a paper-tape and improve the bundling effect by means of the bending deformation of the banknotes during the bundling process, and via a flattening mechanism, the bundled banknotes are bundled tightly and flattened so as to meet the bank storage requirements.

The self-service apparatus according to the present application can realize automatic separating, stacking and bundling, therefore, the stacking, bundling and collecting of the sheet-like mediums may be completed without manual operation, thereby greatly reducing the labor intensity of bank operators and improving work efficiency of the bank.

DETAILED DESCRIPTION OF THE INVENTION

For those skilled in the art to better understand technical solutions of the present application, the sheet-like medium stacking and bundling device according to the present application is further described in detail below in conjunction with drawings and embodiments, by taking an automatic teller machine (ATM) having a function of stacking and bundling banknotes as an example, and certainly besides the banknotes, mediums such as cheques may also be processed.

Figure 1:
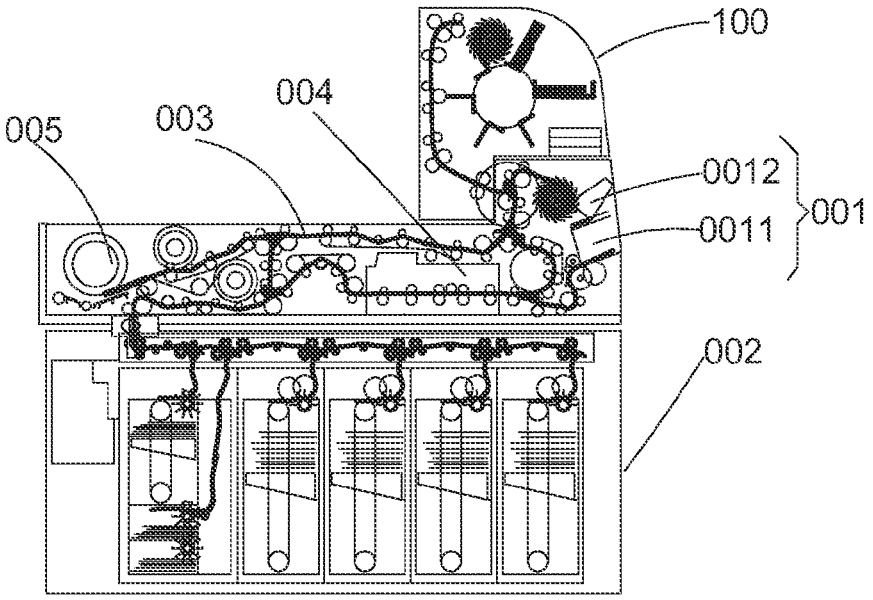
FIG. 1 is a simplified view of a self-service apparatus according to the present application.

Referring to FIG. 1, a typical self-service apparatus is shown, which includes a user operating portion 001, a banknote receiving portion 002, a banknote conveying portion 003, a banknote stacking and bundling device 100, an identification portion 004 for identifying the banknote and a temporary storage portion 005 for temporarily storing banknotes. The user operating portion 001 includes a banknote deposit port 0011 and a banknote withdrawal port 0012. The self-service apparatus has a banknote deposit and withdrawal function, and a banknote bundling function, and the operation process of the apparatus is described briefly hereinafter. When performing the banknote withdrawal operation, the banknotes are separated from the banknote receiving portion 002 and passes through the banknote identification portion 004, then the banknotes meeting requirements are stored in the temporary storage portion 005 temporarily. When meeting the operation requirements, the banknotes stored in the temporary storage portion 005 are conveyed, by the banknote conveying portion 003, to the banknote withdrawal port 0012 or to the banknote stacking and bundling device 100 to be bundled and sent out. When performing the deposit operation, the banknotes are separated from the banknote deposit port 0011 one by one and then are conveyed to the banknote identification portion 004 by the banknote conveying portion 003, then the banknotes meeting requirements are conveyed into the temporary storage portion 005, and after the separation or the temporary storage are finished, the banknotes are conveyed to the banknotes receiving portion 002 by the banknote conveying portion 003, thereby accomplishing the entire deposit operation.

The banknote stacking and bundling device 100 according to the present application is described in detail in conjunction with FIGS. 2 to 25 hereinafter.

Figure 2:
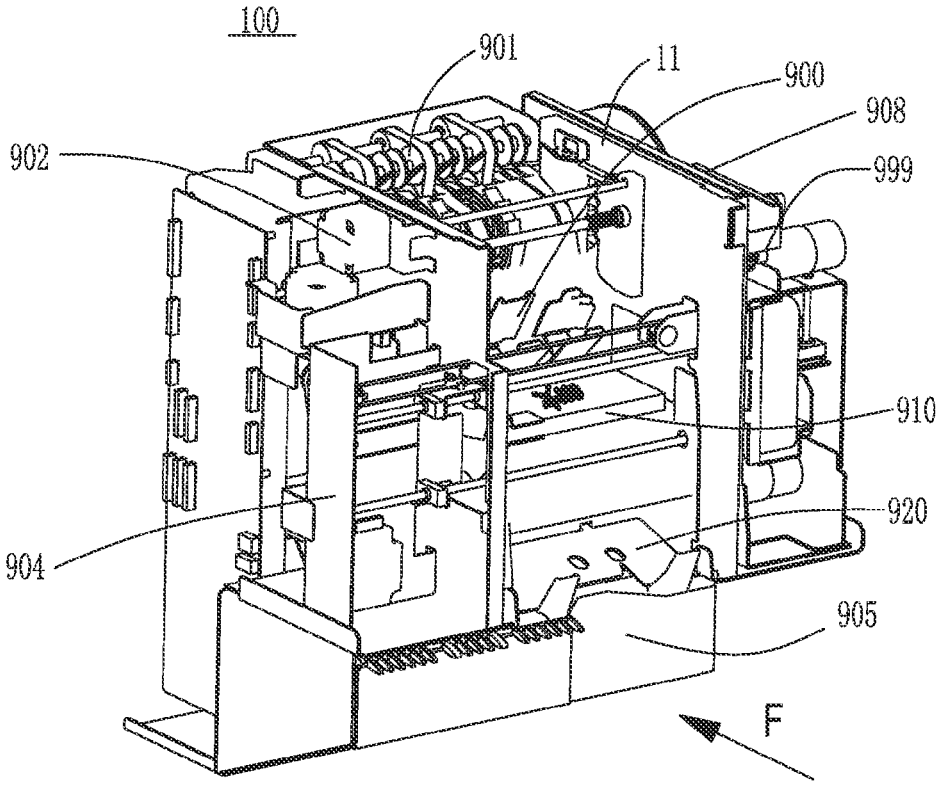
FIG. 2 is an overall view of a banknote stacking and bundling device according to the present application.

Referring to FIG. 2, an overall view of the banknote stacking and bundling device 100 is shown, which includes a single-sheet banknote entering passage 901 butting with the banknote conveying portion 003, a position switching mechanism 900 for stacking banknotes, a banknote tidying mechanism 902, a clamping and conveying mechanism 904, a bundling mechanism 999, a receiving port 920 for receiving a banknote bundle 910, and a frame 905 for supporting the above mechanisms. The position switching mechanism 900 is located at a conveying terminal of the single-sheet banknote entering passage 901 to receive and stack the banknotes entered in single sheet. The banknote tidying mechanism 902 is located at a left side of the position switching mechanism 900, and during the stacking process of the banknotes in the position switching mechanism 900, flaps end portions of the stacked banknotes continuously to make the banknotes stacked tidily. The clamping and conveying mechanism 904 is located at the left side of the position switching mechanism 900 to clamp and convey the stacked banknotes in the position switching mechanism 900 to the bundling mechanism 999 located at a right side of the position switching mechanism 900, and clamp a banknote bundle bundled in the banknote bundling mechanism 999 out of the bundling mechanism 999 and convey the banknote bundle back to the position switching mechanism 900. Then, the banknote bundle is conveyed to the receiving port 920 located at a downstream of the position switching mechanism 900.

Figure 3:
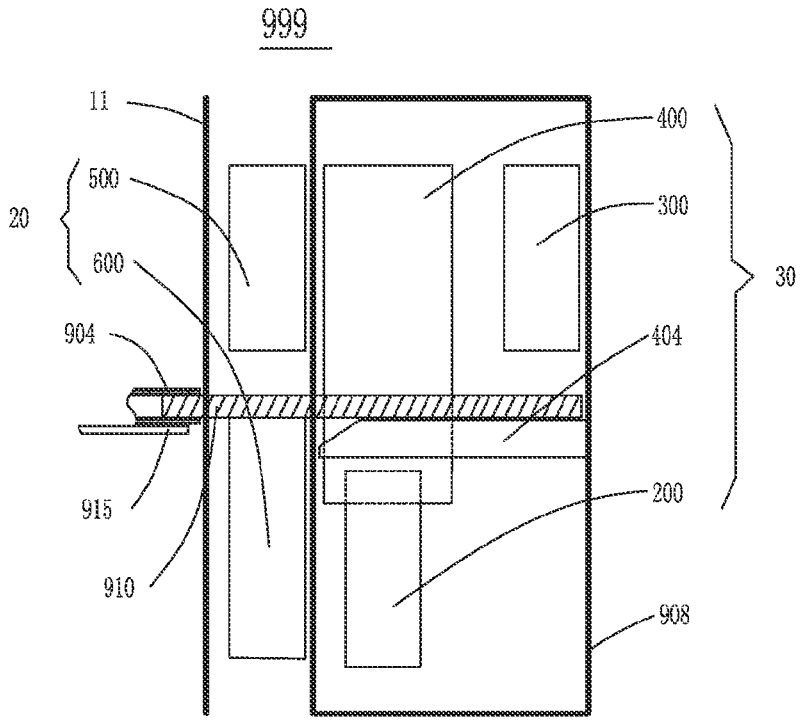
FIG. 3 is a schematic view of the arrangement of mechanisms of the banknote stacking and bundling device in FIG. 2 viewed from a direction F.

The arrangement relationship between the main components of the banknote stacking and bundling device 100 is illustrated in conjunction with FIG. 3.

The bundling mechanism 999 is located at the right side of the position switching mechanism 900, and a passage plate 11 for supporting each assembly is provided between the bundling mechanism 999 and the position switching mechanism 900. All components of the bundling mechanism 999 are fixed on a bundling frame 908, wherein a bundling assembly 30 of the bundling mechanism 999 includes a paper tape loop-forming mechanism 400, a heat and pressure bonding mechanism 200, a paper tape cutting-off mechanism (not shown), and a pressing mechanism 0400 arranged at a right side of the paper tape loop-forming mechanism 400. The pressing mechanism 0400 includes a pressing tongue 404 and a pressing plate assembly 300 arranged at opposite sides of the banknotes to be bundled respectively, wherein a top surface of the pressing tongue 404 is flush with a top surface of a pushing platform 915, and a bottom surface of the pressing tongue 404 is slightly higher than a track surface of the paper tape loop-forming mechanism 400, and a left end of the pressing tongue 404 protrudes out of the paper tape loop-forming mechanism 400 slightly. The paper tape loop-forming mechanism 400 is a guiding groove having an annular track shape, which encircle a left portion of the pressing tongue 404. The heat and pressure bonding mechanism 200 is mounted under the pressing tongue 404 at a position corresponding to a bottom of the guiding groove, and the pressing plate assembly 300 is located at the right side of the paper tape loop-forming mechanism 400 and above the pressing tongue 404. A flattening mechanism 20 is provided between the bundling mechanism 999 and the passage plate 11, the flattening mechanism 20 is located at a left side of the bundling frame 908, and a bundling assembly 30 is mounted at a right side of the flattening mechanism 20. The flattening mechanism 20 includes a supporting mechanism 600 located at a lower portion of the flattening mechanism 20, and a flapping mechanism 500 located at an upper portion of the flattening mechanism 20 corresponding to the supporting mechanism 600. The supporting mechanism 600 is driven by a scissor-type mechanism to form a high position and a low position, and the high position, formed when the scissor-type mechanism opens, is slightly higher than top surfaces of the pushing platform 915 and the pressing tongue 404, thereby ensuring the smooth pushing of the banknotes from left to right. The flapping mechanism 500 is driven by a crank-slider mechanism to perform reciprocating movement towards the supporting mechanism 600, thereby flapping and flattening the banknotes.

The main components of the bundling module are illustrated in conjunction with FIGS. 4 to 10.

Figure 4:
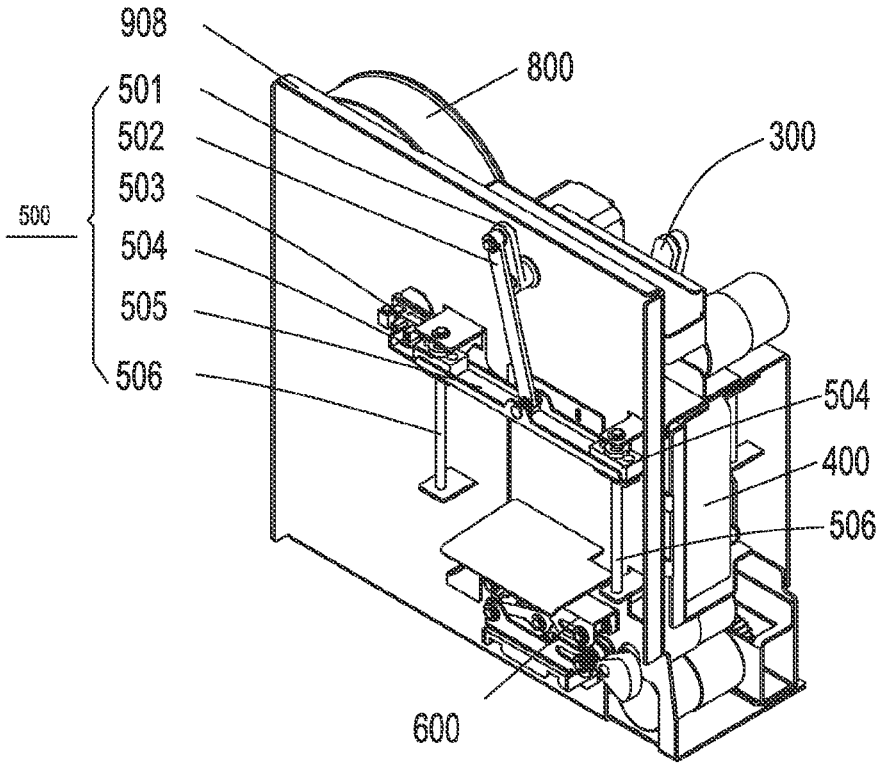
FIG. 4 is a first perspective view of a bundling mechanism of the banknote stacking and bundling device in FIG. 1.
Figure 5:
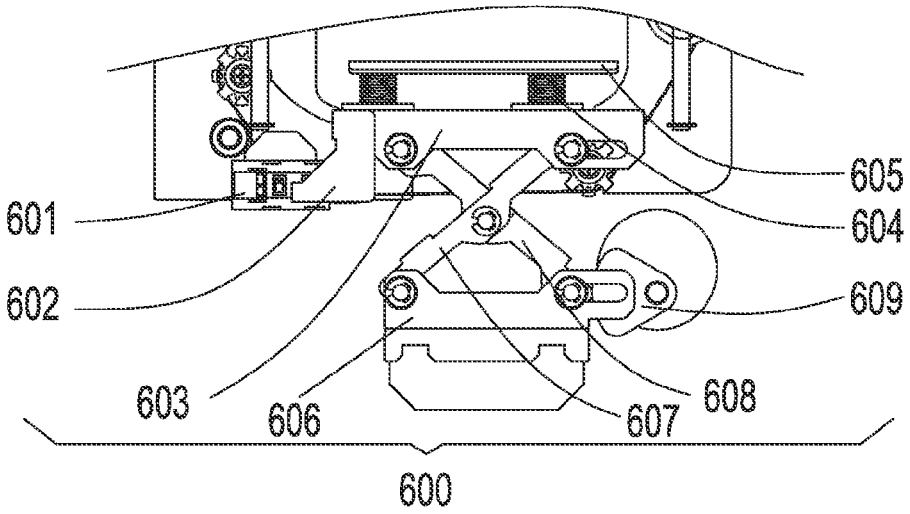
FIG. 5 is a partial front view of a supporting mechanism of the bundling mechanism in FIG. 4.

FIGS. 4 and 5 show the mechanisms at the left side of the bundling frame 908, which are the flapping mechanism 500 and the supporting mechanism 600 through which the banknotes 910 passes firstly. The flapping mechanism 500 is located at the upper portion and is driven by the crank-slider mechanism to perform a reciprocating movement from top to bottom, the crank-slider mechanism includes a driving crank 501, a connecting rod 502, a guide sleeve 504, a flattening plate 505 and a sliding shaft 506, and an initial position of the flapping mechanism 500 is detected by a sensor 503. The supporting mechanism 600 is located at the lower portion, and a scissor-type mechanism is formed by a base 606, a connecting rod 607, a connecting rod 608 and a top plate 603. A banknote supporting plate 605 and a returning spring 604 are mounted on a top portion of the top plate 603, and a left and right reciprocating movement of the scissor-type mechanism driven by an eccentric wheel 609 is converted to a up and down movement of the banknote supporting plate 605. A detecting assembly of the supporting mechanism 600 is formed by a sensor 601 and a stopper 602. Preferably, the flattening plate 505 and the banknote supporting plate 605 are aligned with a central plane of an opening of the paper tape loop-forming mechanism 400, and when the banknote supporting plate 605 is in a highest position, the flattening plate 505 moves towards the banknote supporting plate to flap the banknotes on the banknote supporting plate for several times, thereby realizing the function of flattening the stacked banknotes.

Figure 6:
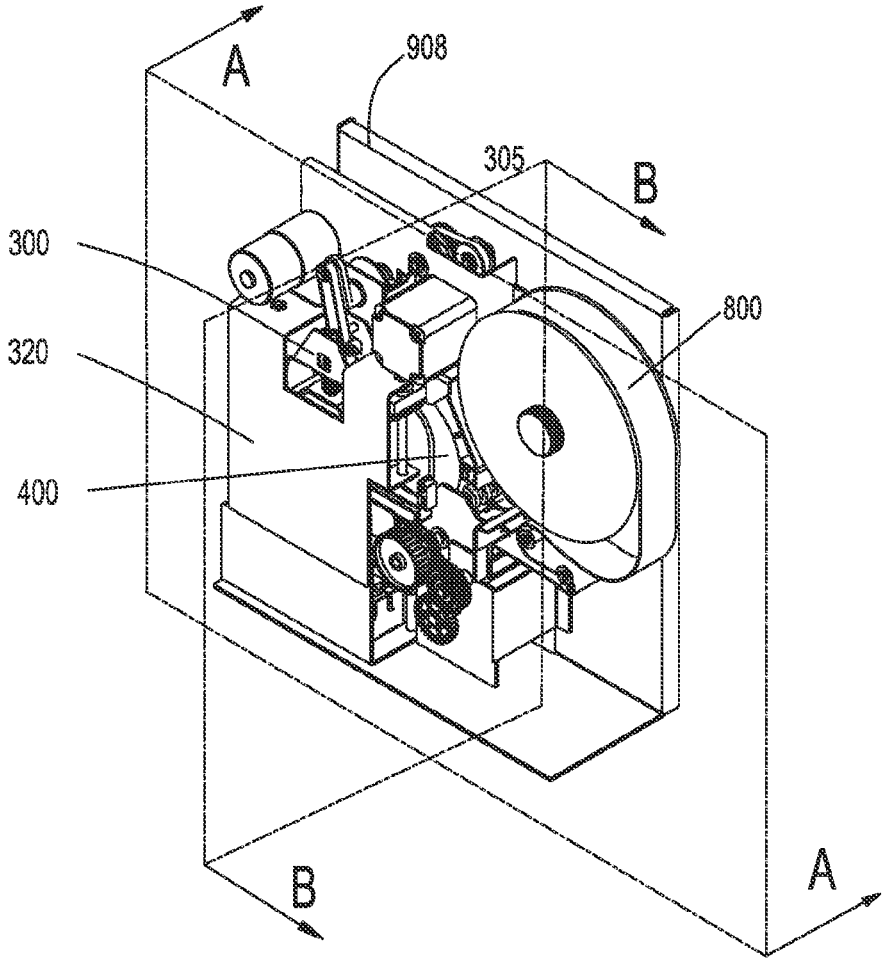
FIG. 6 is a second perspective view of the bundling mechanism of the banknote stacking and bundling device in FIG. 1.
Figure 7:
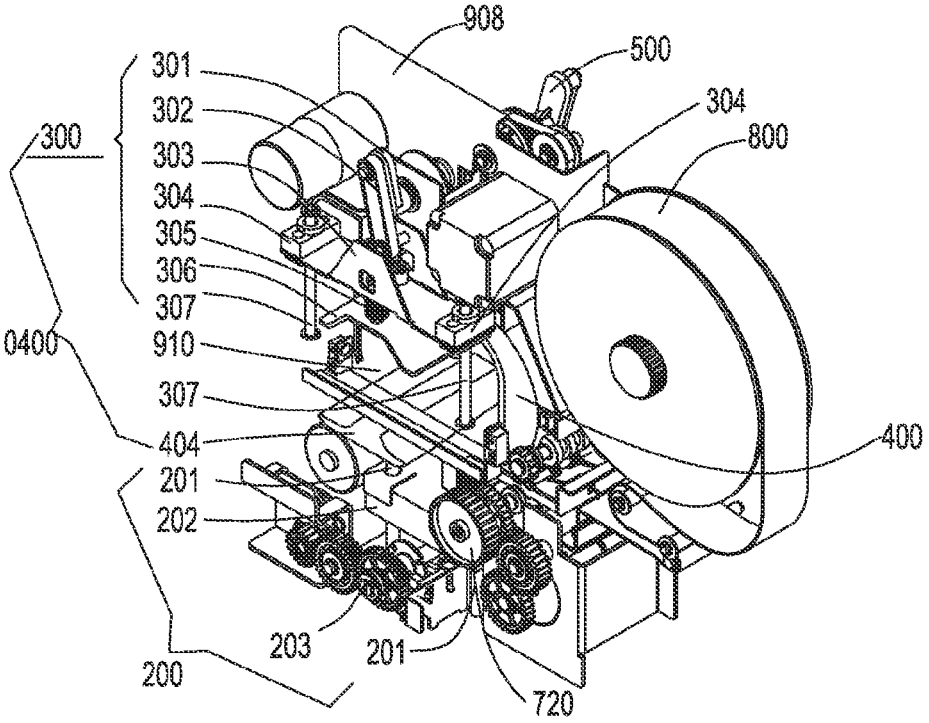
FIG. 7 is a schematic view of the second perspective view of the bundling mechanism in FIG. 6 with a fixing plate being removed.
Figure 8:
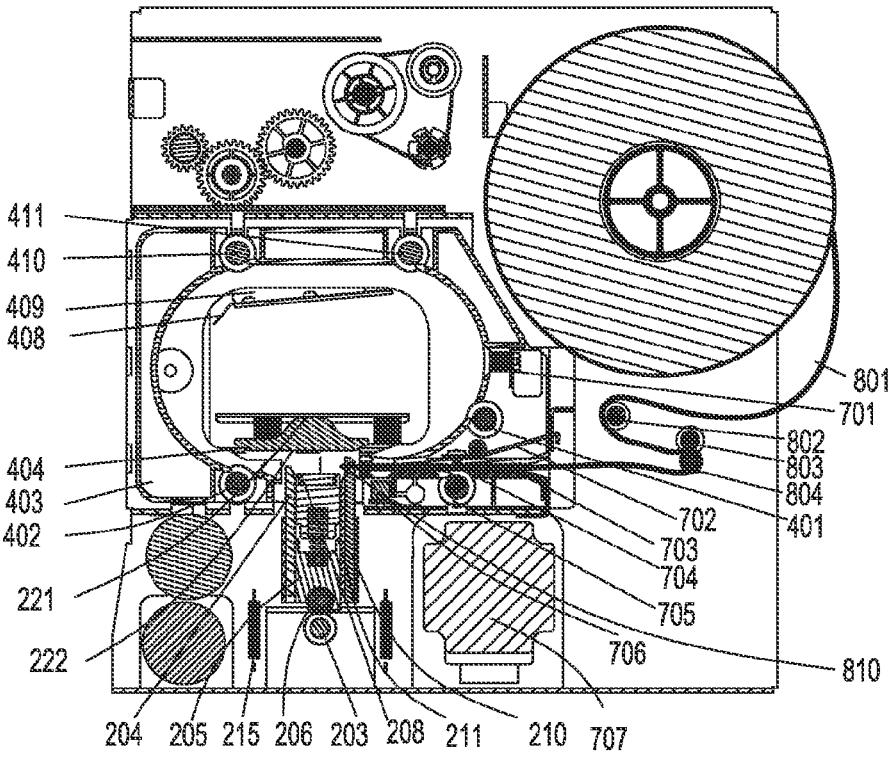
FIG. 8 is a sectional view taken along a plane A-A in FIG. 6.

Referring to FIGS. 6 to 8, mechanisms at the other side of the bundling frame 908 are shown. The paper tape loop-forming mechanism 400 and the heat and pressure bonding mechanism 200 are respectively mounted at positions corresponding to central planes of the flapping mechanism 500 and the supporting mechanism 600, and the pressing plate assembly 300 is mounted on the right side of the paper tape loop-forming mechanism 400 and is fixed to the bundling frame 908 via a fixing plate 320. A crank-slider mechanism of the pressing plate assembly 300 is formed by a crank 301, a connecting rod 302, a driving plate 303, a guide sleeve 304, a returning spring 305, a pressing plate 306 and a guide shaft 307. The driving plate 303 can slide up and down along the guide shaft 307, and a position state of the driving plate 303 is detected by an encoder which is not shown. The pressing plate 306 is of a substantially "⌂" shape, and a pressing tongue 404 having a substantial triangular shape matching the shape of the pressing plate 306 is provided under the pressing plate 306. The pressing tongue 404 is fixed to the bundling frame 908, and a top surface 221 of the pressing tongue 404 is slightly lower than the banknote supporting plate 605 in the highest position, such that the banknotes can slide easily from the banknote supporting plate 605 to the pressing tongue 404. A lower surface 222 of the pressing tongue 404 faces the heat and pressure bonding mechanism 200. The heat and pressure bonding mechanism 200 includes a rear pressing head 204, a heating head body 205, a roller 206, a heating head 208, a cutter 211, a front pressing head 210, all of which are mounted on a heating head base 202 and are driven with the heating head base 202 by a camshaft 203 to slide up and down along a guide shaft 201. At the same time, the rear pressing head 204, the heating head 208, the cutter 211 and the front pressing head 210 may also move up and down in a vertical direction, and a spring 215 provides a returning force. One end of the spring 215 is connected to the frame 908, and the other end of the spring 215 is connected to the heating head base 202, so as to provide a returning force for the downward sliding of the heat and pressure bonding mechanism 200.

Figure 9:
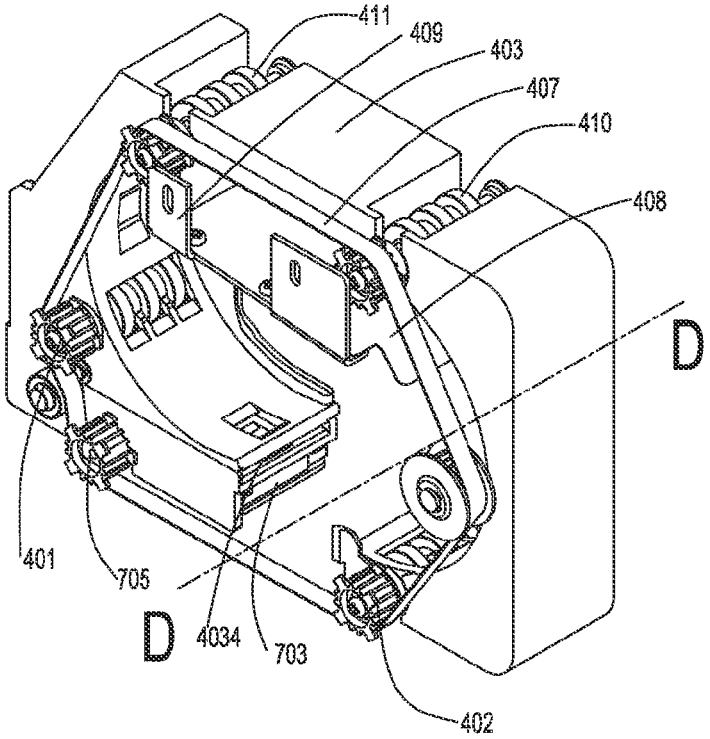
FIG. 9 is an isometric side view of a paper tape loop-forming mechanism of the bundling mechanism in FIG. 7.
Figure 10:
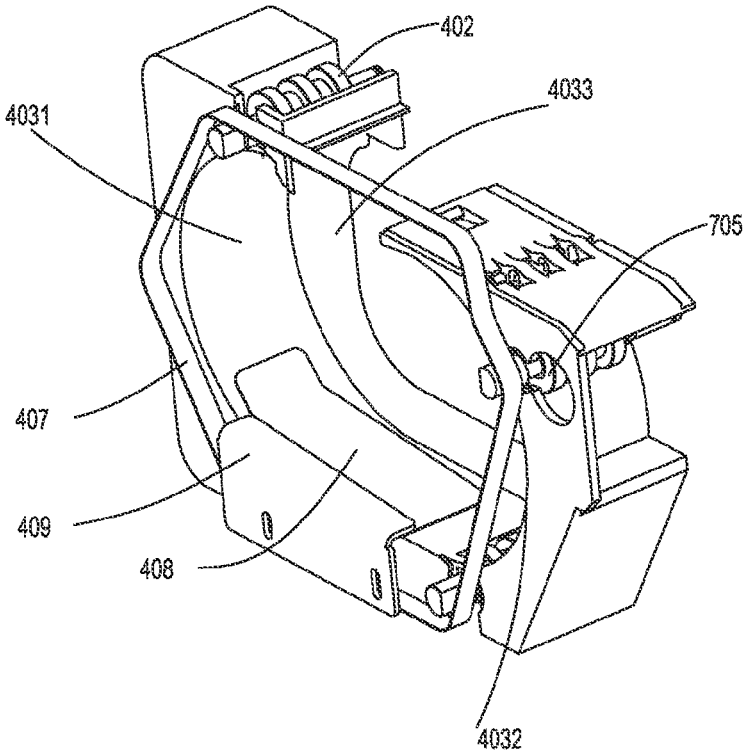
FIG. 10 is an isometric side view of the paper tape loop-forming mechanism rotating 180° about an axis D-D in FIG. 9.

The main components of the paper tape loop-forming mechanism 400 and the arrangement manner thereof is illustrated in conjunction with FIGS. 8 to 10. The paper tape loop-forming mechanism 400 includes a track 403 formed by the guiding groove having an annular track shape, a head and a tail of the guiding groove are connected to form a conveying loop, and the guiding groove includes a bottom portion 4031, an opening 4032 corresponding to the bottom portion 4031, and two corresponding groove side walls 4033 extending between the bottom portion 4031 and the opening 4032. The opening 4032 faces an inner side of the conveying loop, and a first power wheel 401, a second power wheel 402, a third power wheel 410 and a fourth power wheel 411 are disposed at four corners of the opening 4032 and may perform synchronized motion via a synchronous belt 407. A paper tape conveying motor 707 drives a driving wheel 705 via a driving shaft so as to provide power to the synchronous belt. The surfaces of the four power wheels are covered with rubber so as to increase the conveying force for the paper tape. In addition, the heat and pressure bonding mechanism 200 and the paper tape cutting-off mechanism are located at the bottom portion of the guiding groove closing to a paper tape inserting port 4034, and an elastic guiding member 408, parallel to the bottom portion of the guiding groove, is provided at an opening end of the groove side walls. The guiding member 408 and an inner surface, for conveying the paper tape, of the track 403 form a semi-closed passage. Preferably, the guiding member 408 includes a bending portion bending towards the inside of the track 403 and formed at a portion of the semi-closed passage, through which the paper tape passes firstly, such that the paper tape may pass through the track more easily and have a trend of going up gradually when moving rightward. The guiding member 408 is mounted on a fixing plate 409 mounted on the bundling frame 908. A sensor 706 for detecting the existence of the paper tape is provided at an entrance of the track.

It should be noted that, the shape of the guiding groove is not limited to the annular track shape, can also be other shapes with a head and a tail connected, such as circular, elliptical, and the object of the present application can also be realized.

Figure 11:
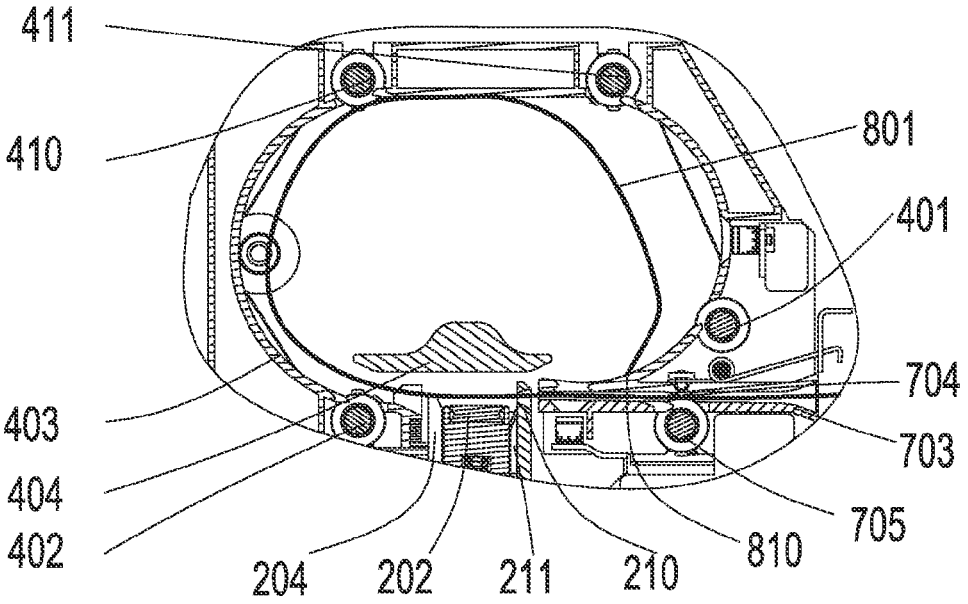
FIG. 11 is a schematic view showing a possible state of the paper tape when the paper tape loop-forming mechanism has no elastic member.

FIG. 11 shows a state of the paper tape, which may happen most possibly when moving in the track, when there is no guiding member 408. As shown in FIG. 11, since a resistance force, produced when a paper tape head 810 contacts the track 403, is larger than a tension force generated by a rigidity of the paper tape 801, the paper tape head cannot enter a predetermined position under the bottom surface of the pressing tongue 404 and at a top surface of a left side of the front pressing head 210, which can refer to FIG. 15, so that the paper tape cannot form a loop and accordingly subsequent actions can not be performed.

The principle of moving forward and backward of the paper tape 801 is illustrated in conjunction with FIG. 8. After being led out from a paper reel assembly 800, the paper tape head 810 of the paper tape 801 bypasses a first guide wheel 802, and passes through a limit passage formed between a second guide wheel 803 and a third guide wheel 804, and then is inserted into a passage formed between a lower passage plate 703 and the track 403. By rotating a hand wheel 720, the driving wheel 705 and a driven wheel 704 are driven to champ and convey the paper tape 801 leftward. When performing a power-on initialization, the paper tape conveying motor 707 drives the driving wheel 705 to convey the paper tape 801 leftward, and after the paper tape head 810 is detected by the sensor 706, the paper tape is conveyed continually for a fixed length to pass through a hole in the front pressing head 210, and the paper tape head 810 can flush with or slightly protrude out of the left side of the front pressing head 210, as shown in FIG. 8. Then, the sensor 710 determines whether or not the paper tape forms a loop. If the sensor 710 detects the passing of the paper tape within a specified time, that indicates the loop-forming of the paper tape is successful; If the sensor 710 does not detect the passing of the paper tape within a specified time, the paper tape head is drew back to the sensor 706 to try to form a loop again. When drawing back the paper tape, the paper tape conveying motor 707 drives the driving wheel 705 to convey the paper tape rightward. The conveying force for the paper tape can be adjusted by adjusting a torsion force of a pressure spring 702 of the driven wheel 704.

The bundling process of the banknote stacking and bundling device is further illustrated in conjunction with FIGS. 12 to 25.

Figure 12:
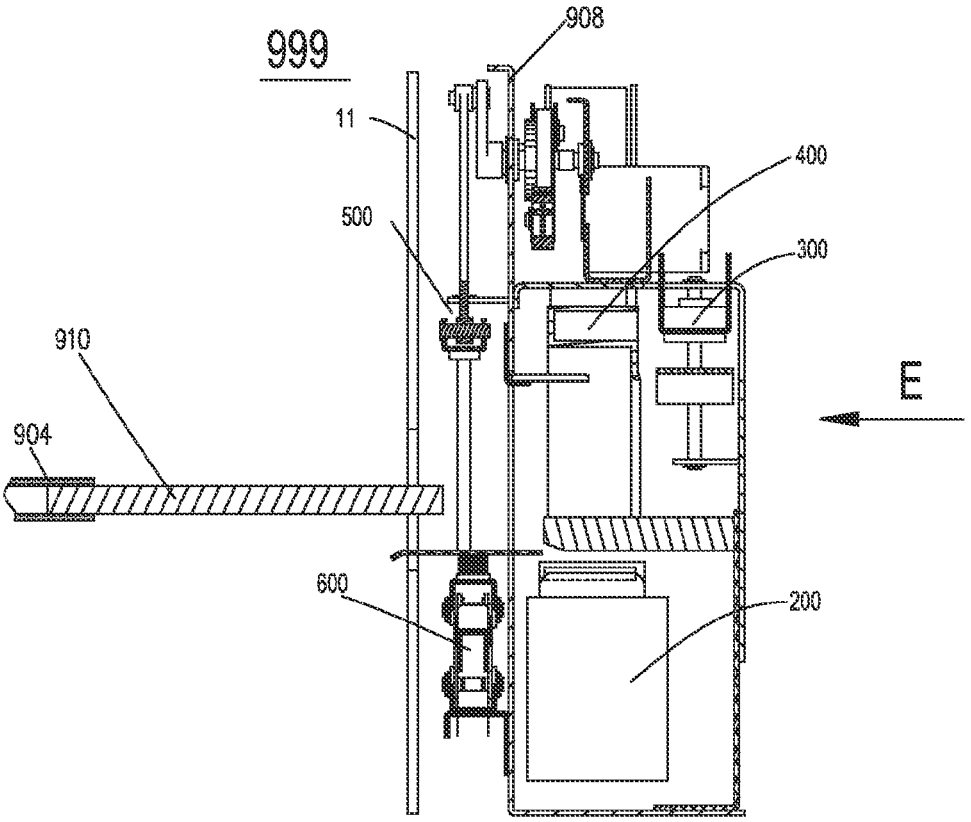
FIG. 12 is a sectional view taken along a plane B-B in FIG. 6 when banknotes enter the bundling mechanism.
Figure 13:
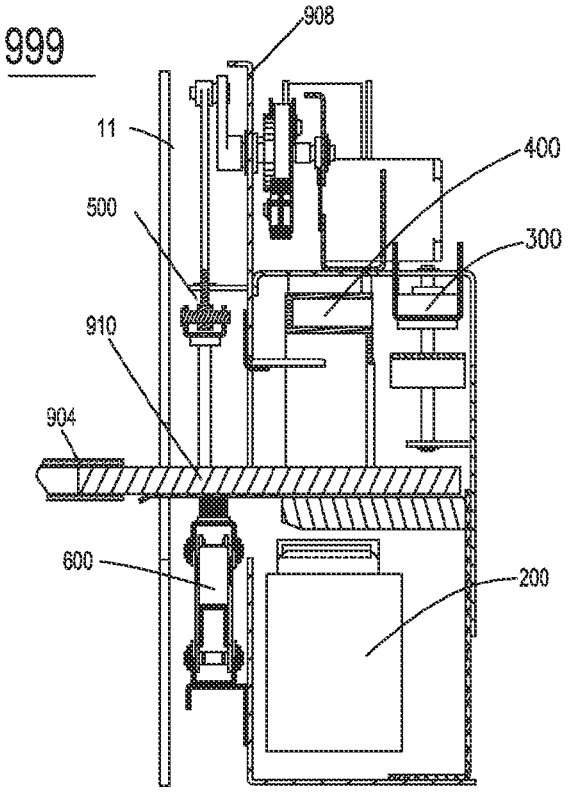
FIG. 13 is a sectional view taken along the plane B-B in FIG. 6 when the banknotes are in place.
Figure 14:
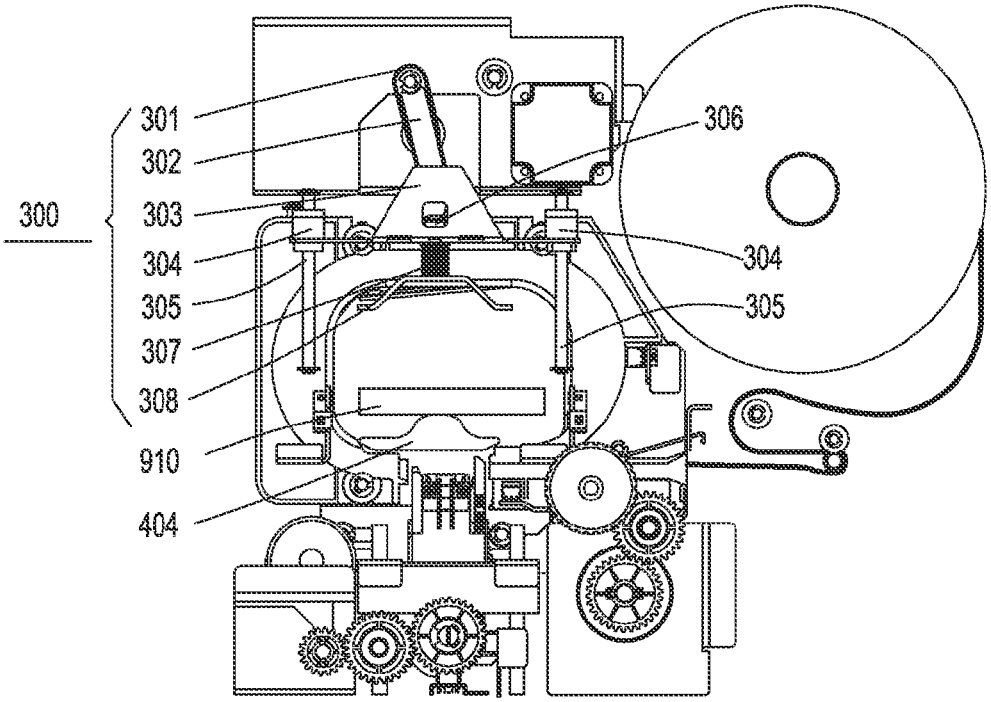
FIG. 14 is a view seen from a direction E in FIG. 12 showing a state of a pressing mechanism when the banknotes are entered.

FIGS. 12 to 13 shows the process of the banknotes 910 entering the interior of the bundling assembly 30. Firstly, the clamping and conveying mechanism 904 conveys the banknotes 910, and when a right end of the banknotes 910 exceeds the passage plate 11 for about 10 mm, the supporting mechanism 600 is raised to the highest position to prevent conveying failure caused by an over falling amount of the right end of the banknotes 910. Then, the banknotes 910 are continuously conveyed rightward by the clamping and conveying mechanism 904 until reaching a predetermined position. During the above process, only the supporting mechanism moves to a working position, other mechanisms are all in initial states. As shown in FIG. 13, the state of the mechanisms viewed from the direction E in FIG. 8 is shown, wherein the fixing plate 320 of the pressing plate assembly 300 is omitted.

The bundling process of the banknote stacking and bundling device is further described in conjunction with FIGS. 15 to 25.

Figure 15:
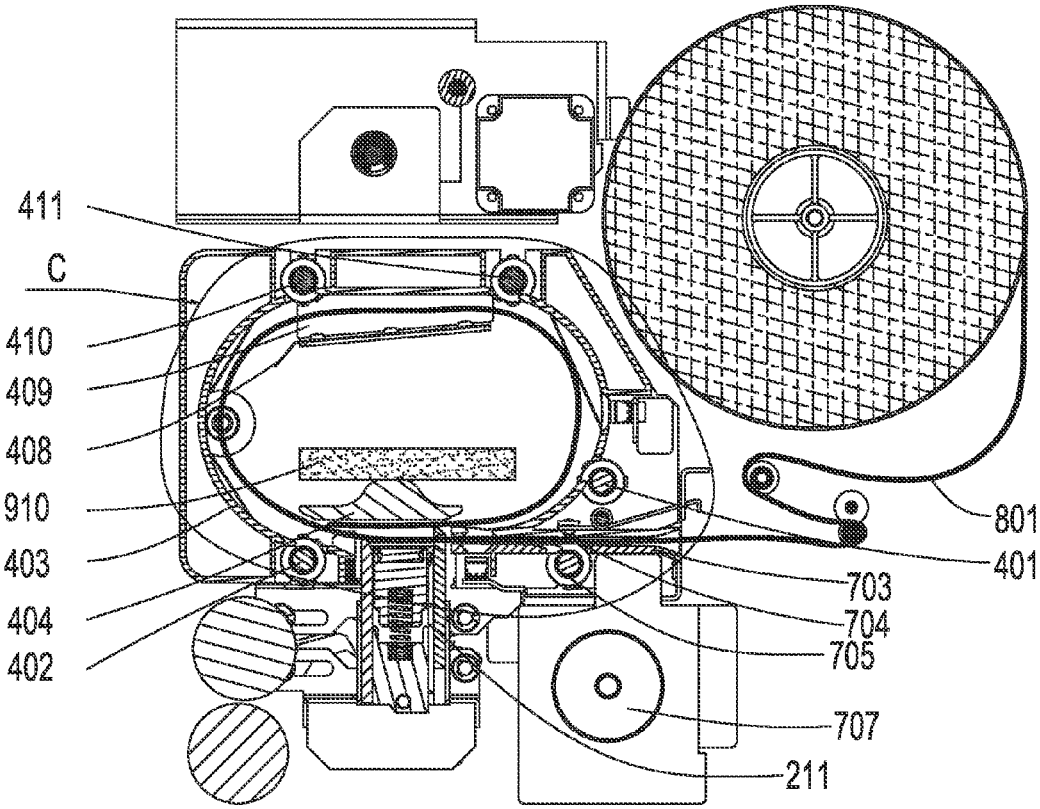
FIG. 15 is a sectional view taken along the plane A-A in FIG. 6 when the paper tape loop-forming is in place.

FIG. 15 shows the loop-forming process of the paper tape 801. The paper tape 801 is clamped and conveyed by the driving wheel 705 and the driven wheel 704 leftward, and passes through the hole in the front pressing head 210 firstly, then is conveyed by the power wheels 402, 410, 411 to firm a loop along the inner wall of the track 403; and meanwhile, the paper tape conveying motor 707 calculates a conveyed length of the paper tape and is stopped until a specified length is reached, and the final loop-forming effect is shown in FIG. 15. During the conveying process, when the paper tape head 810 subjects to a resistance force, the other portion of the paper tape behind the paper tape head 810 may expand towards the track, and then may be driven by tangential forces when contacting the surfaces of the power wheels 402, 410, 411, thereby reducing the possibility of the paper tape head 810 being blocked and improving the reliability of the loop-forming of the paper tape.

Figure 16:
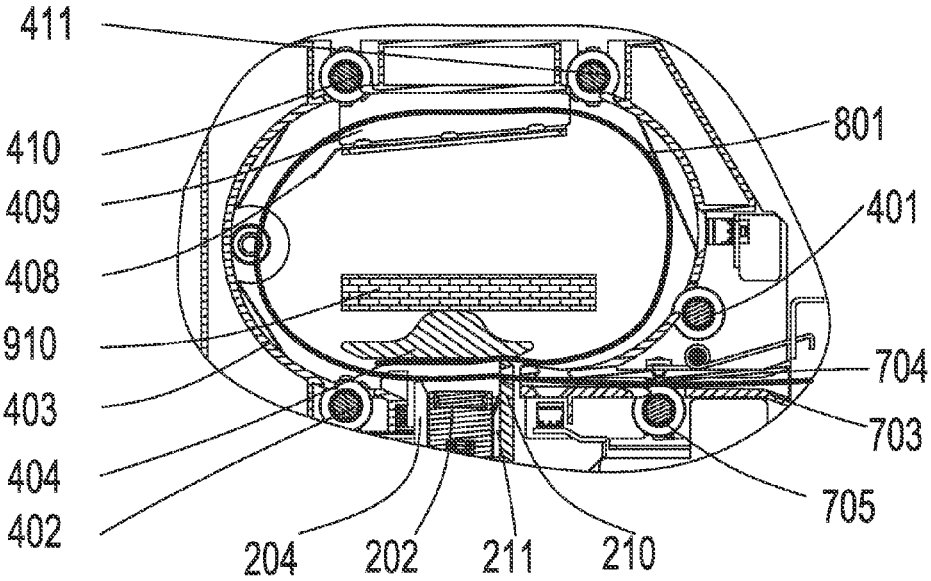
FIG. 16 is a schematic view of a part C in FIG. 15 when the paper tape is pressed tightly.

Next, as shown in FIG. 16, the heat and pressure bonding mechanism 200 moves upwardly to a first position, at this time, the front pressing head 210 firstly contacts the lower surface of the pressing tongue 404 and presses the paper tape 801 tightly.

Figure 17:
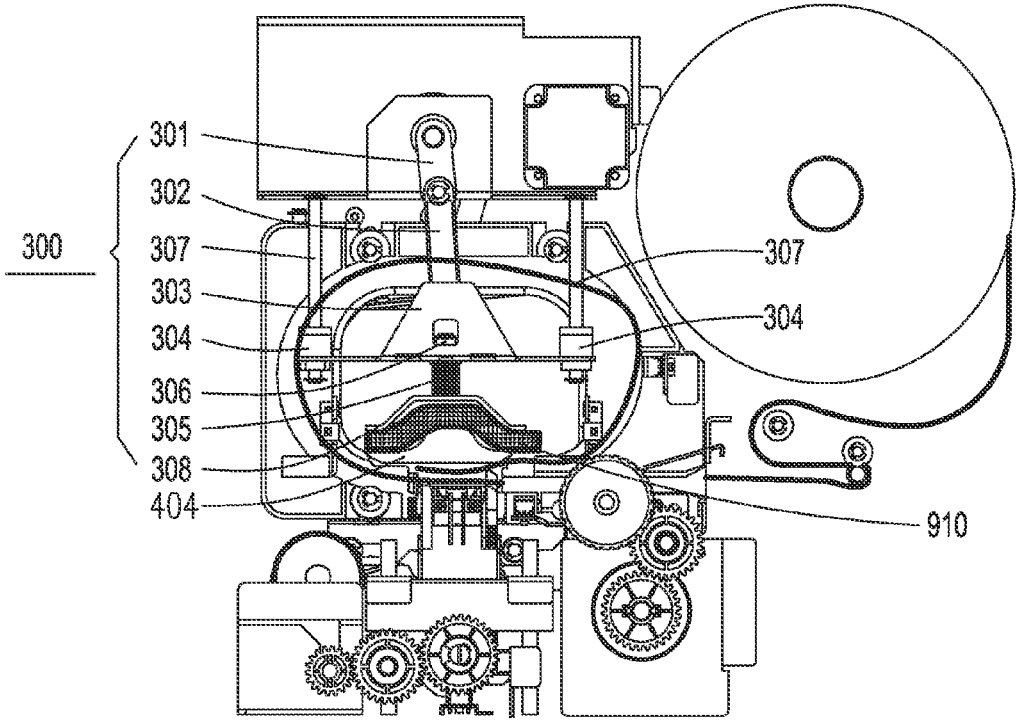
FIG. 17 is a view seen from the direction E in FIG. 12 showing the pressing mechanism pressing the banknotes tightly.

Then, as shown in FIG. 17, the pressing plate assembly 300 moves downwardly and presses the banknotes 910 tightly on the pressing tongue 404. The pressing plate 308 has a shape similar to the pressing tongue 404, i.e. the middle portion is higher and the two sides are lower, thus the banknotes are pressed into a "⊞" shape.

Figure 18:
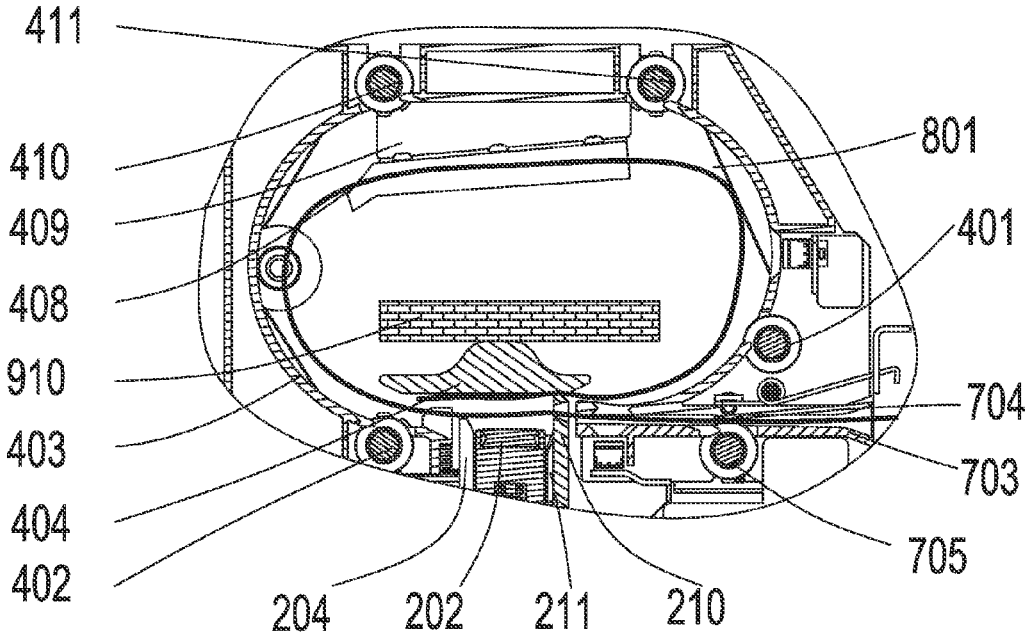
FIG. 18 is a partial sectional view taken along the plane A-A in FIG. 6 showing the paper tape being separated from a guiding member.
Figure 19:
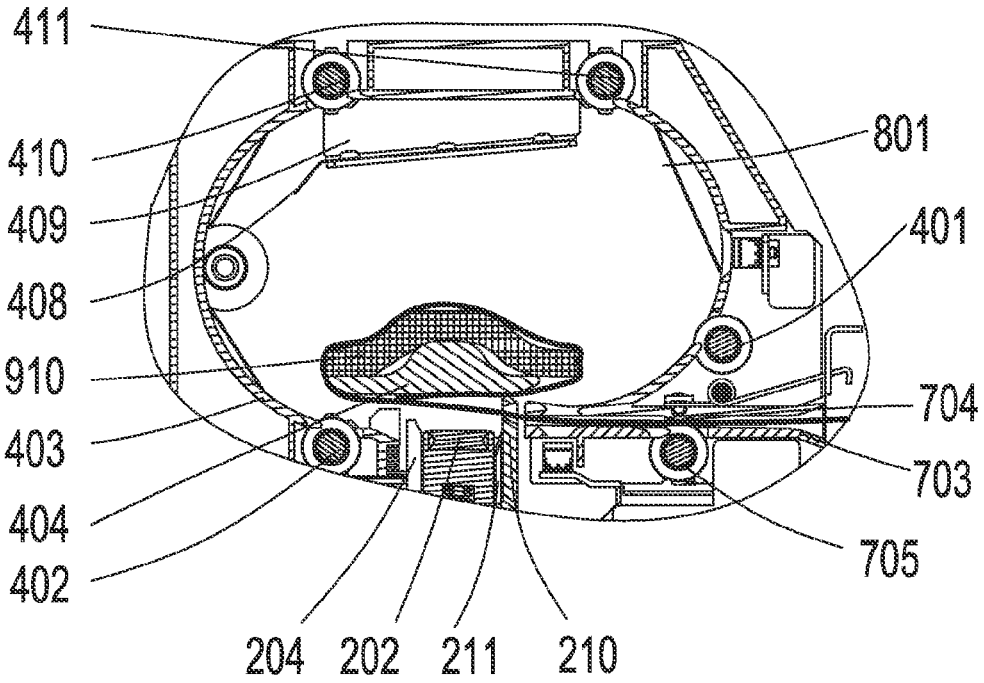
FIG. 19 is a partial sectional view taken along the plane A-A in FIG. 6 showing the paper tape being pulled back and tightened.

As shown in FIG. 18, the driving wheel 705 rotates reversely to draw the paper tape 801 leftward, and since the guiding member 408 is elastic, the existence of the guiding member 408 will not affect the retracting of the paper tape 801 from the guiding member 408 towards the banknotes 910. The bank tape 801 in a tensioning state is shown in FIG. 19, at this time, a length of the paper tape 801 surrounding the stacked banknotes for one circle is just equal to a perimeter, in a width direction, of the stacked banknotes in flattening state.

Figure 20:
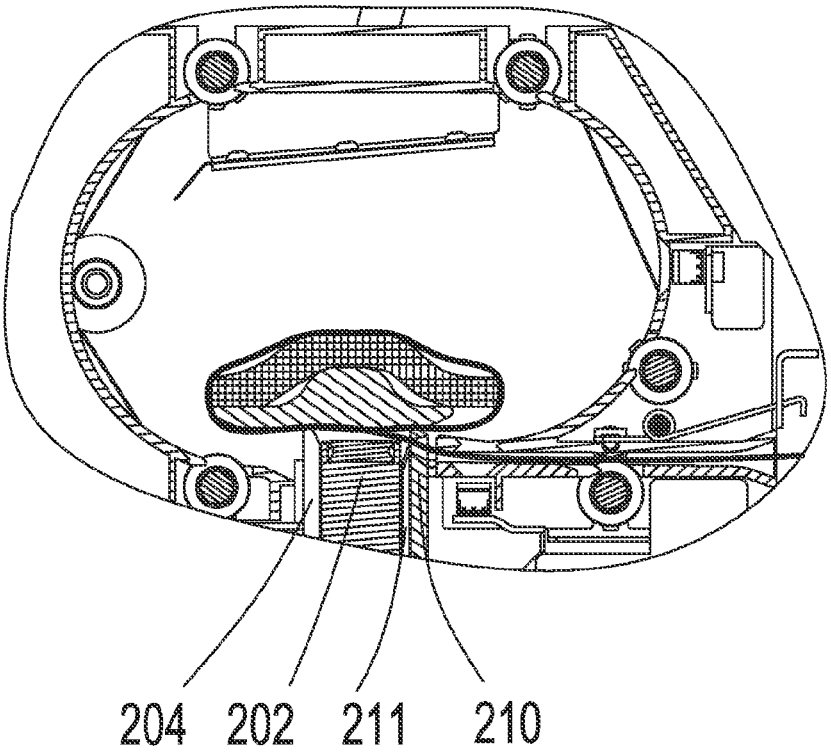
FIG. 20 is a partial sectional view taken along the plane A-A in FIG. 6 showing a pressing head pressing the paper tape tightly.

Then, as shown in FIG. 20, the heat and pressure bonding mechanism 200 moves upwardly to a second position, at this time, the rear pressing head 204 also contacts the lower surface of the pressing tongue 404 and presses the paper tape between a top surface of the rear pressing head 204 and the lower surface of the pressing tongue tightly.

Figure 21:
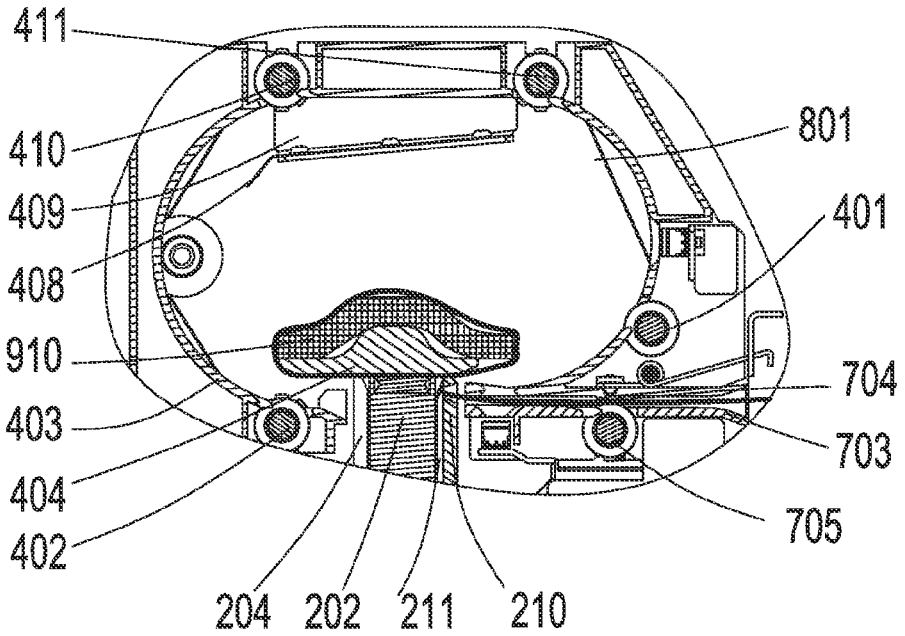
FIG. 21 is a partial sectional view taken along the plane A-A in FIG. 6 showing the paper tape being cut off and bonded.

Finally, as shown in FIG. 21, the heat and pressure bonding mechanism 200 moves upwardly to a third position, during this process, since a position of a portion of the paper tape adjacent to the front pressing head 210 is lower than a position of a portion of the paper tape adjacent to the rear pressing head 204, the paper tape 801 is cut off when the cutter 211 moves upwardly and forms a cutting edge with the front pressing head 210. When reaching the third position, the heat and pressure bonding mechanism 200 stays for a certain time to ensure the bonding effect of the paper tape. The motor 707 is kept in a power-on state during the process from the paper tape being tensioning to the paper tape being cut off, so as to ensure the cutting effect of the paper tape. After the delay, the heat and pressure bonding mechanism is return to the original position and the bundling is completed, and the position of the paper tape head at this time is shown in FIG. 8.

Figure 22:
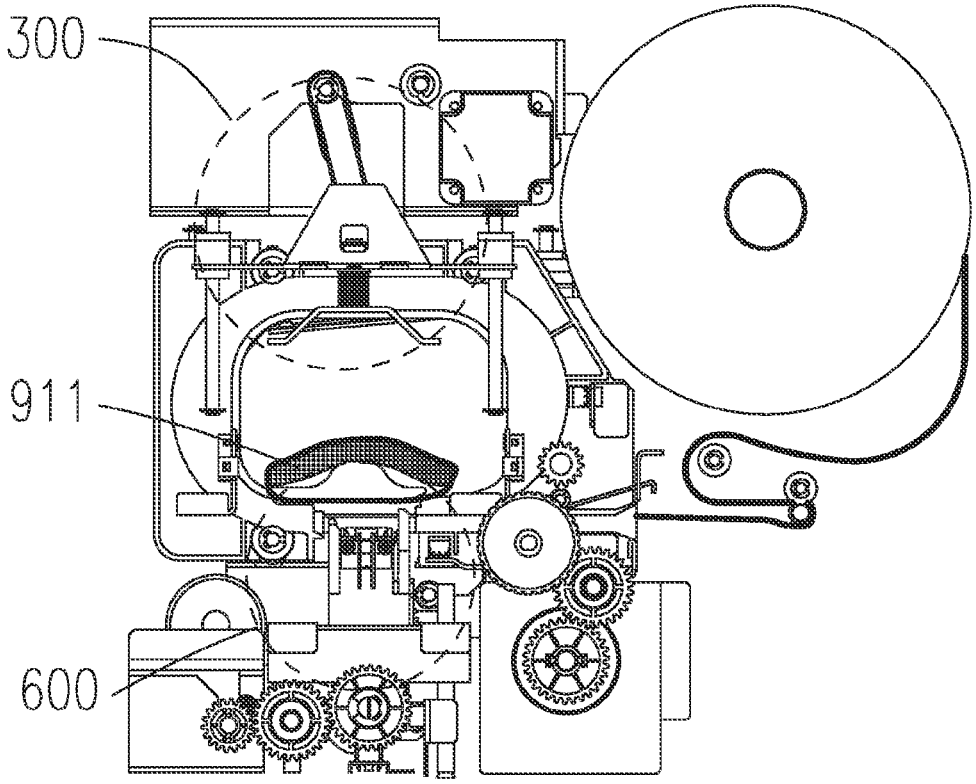
FIG. 22 is a view seen from the direction E in FIG. 12 showing a state of the banknotes after being bundled.

After the bundling is completed, the pressing plate assembly 300 returns to the original position, and at this time, the states of the mechanisms are shown in FIG. 22. A bundled banknotes is denoted as 911 and the paper tape bundled on the banknotes 911 is denoted as 802, so as to distinguish from the unbundled banknotes 910 and paper tape 801.

Figure 23:
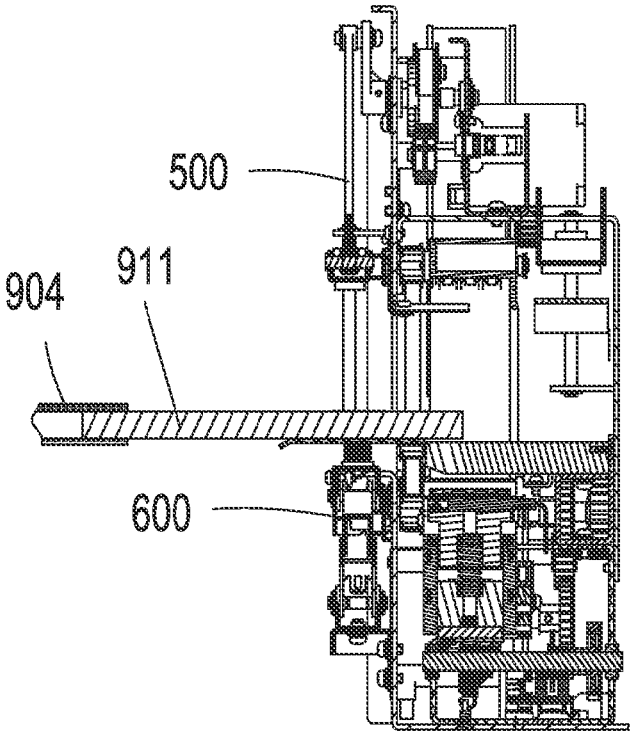
FIG. 23 is a sectional view taken along the plane A-A in FIG. 6 showing the banknotes being drew to a flattening position.

Next, as shown in FIG. 23, the clamping and conveying mechanism 904 drags the banknotes 911 leftward, such that the paper tape 802 and the flattening plate 505 are substantially located in a same vertical plane.

Figure 24:
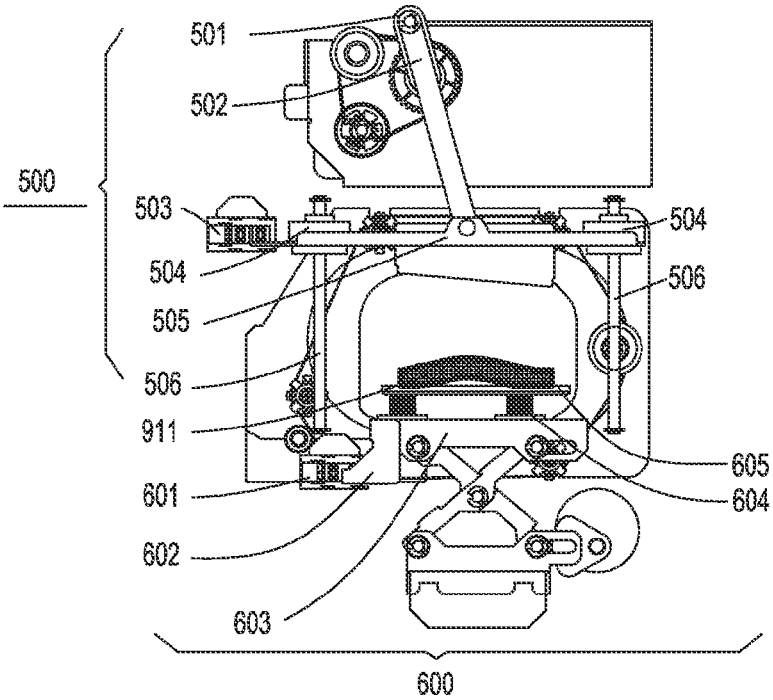
FIG. 24 is a view seen from the direction E in FIG. 12 showing a flattening mechanism in an initial position.
Figure 25:
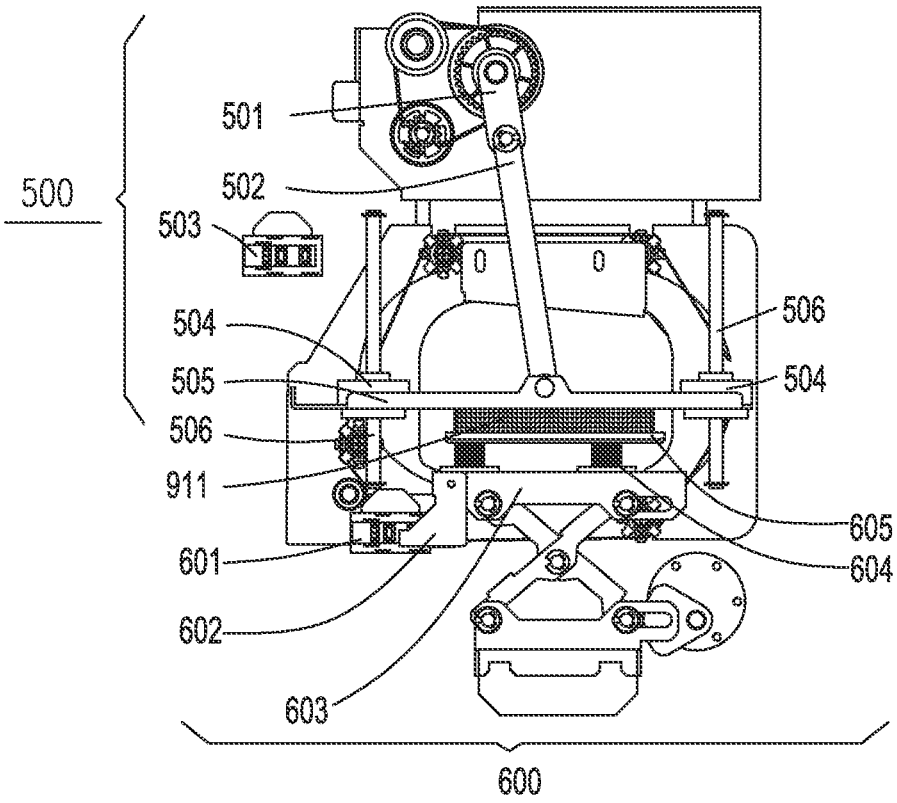
FIG. 25 is a view seen from the direction E in FIG. 12 showing the flattening mechanism in a lowest position.

Then, the flapping mechanism 500 starts to operate, the flattening plate 505 moves downwardly to flap the banknotes 911. The banknotes 911 tend to be flattened under a downward pressure of the flattening plate 505, as shown in FIGS. 24 and 25. The flattening process is completed after the flapping mechanism 500 performs the flapping for several times.

Finally the clamping and conveying mechanism 904 drags the banknotes 911 back into the position switching mechanism 900, the supporting mechanism 600 returns to the original position, the banknotes 911 are carried to the receiving port 920 by the position switching mechanism 900, thereby completing the bundling process.

The above description is only preferred embodiments of the present application. It should be noted that, the above preferred embodiments are not intended to limit the present application, and the protection scope of the present application is defined by the claims of the present application. For the person skilled in the art, many modifications and improvements may be made to the present application without departing from the principle of the present application, and these modifications and improvements are also deemed to fall into the protection scope of the present application.

The invention claimed is:

1. A sheet-like medium stacking and bundling device, comprising:

a sheet-like medium stacking mechanism, adapted to stack and tidy sheet-like mediums conveyed one by one;

a bundling mechanism, adapted to bundle a whole stack of stacked and tidied sheet-like mediums; and a clamping and conveying mechanism, adapted to clamp and convey the whole stack of sheet-like mediums stacked and tidied by the sheet-like medium stacking mechanism to the bundling mechanism to be bundled, and clamp a bundled sheet-like mediums bundle out of the bundling mechanism;

wherein the bundling mechanism comprises a paper tape loop-forming mechanism, a heat and pressure bonding mechanism and a paper tape cutting-off mechanism; the paper tape loop-forming mechanism comprises a guiding groove for guiding the paper tape, and a head and a tail of the guiding groove are connected to form a conveying loop; the guiding groove comprises a bottom portion, an opening corresponding to the bottom portion, and two corresponding groove side walls extending between the bottom portion and the opening, and the opening faces an inner side of the conveying loop; a paper tape inserting port and at least one paper tape conveying wheel are provided at the bottom portion of the guiding groove; the heat and pressure bonding mechanism and the paper tape cutting-off mechanism are located at the bottom portion of the guiding groove close to the paper tape inserting port; and a guiding member, having elasticity and parallel to the bottom portion of the guiding groove, is provided at an opening end of the groove side walls; and wherein the bundling mechanism further comprises a pressing mechanism, which is located at a side of the guiding groove opposite to the clamping and conveying mechanism, and comprises a pressing tongue and a pressing plate assembly arranged at opposite sides of sheet-like mediums to be bundled respectively; wherein the pressing tongue extends into the guiding groove, a bonding portion of the loop-forming paper tape is clamped between the pressing tongue and the heat and pressure bonding mechanism, and the pressing plate assembly is driven by a crank and connecting rod mechanism to move towards the pressing tongue to perform a pressing action or move away from the pressing tongue to perform a releasing action.

2. The sheet-like medium stacking and bundling device according to claim 1, wherein the guiding groove is of an annular track shape.

3. The sheet-like medium stacking and bundling device according to claim 2, wherein there are four paper tape conveying wheels respectively distributed at four corners of the guiding groove having the annular track shape.

4. The sheet-like medium stacking and bundling device according to claim 1, wherein the pressing plate assembly comprises a driving plate driven by a crank and connecting rod mechanism, and an elastic pressing plate is provided on a side of the driving plate facing the pressing tongue.

5. The sheet-like medium stacking and bundling device according to claim 4, wherein the pressing tongue is of a substantially triangular shape, the elastic pressing plate is of a substantially " 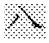 " shape, and the sheet-like mediums between the pressing tongue and the elastic pressing plate are pressed tightly by the pressing tongue and the elastic pressing plate to form deformation.

6. The sheet-like medium stacking and bundling device according to claim 1, wherein the bundling mechanism further comprises a flattening mechanism, which is located at a side of the guiding groove close to the clamping and conveying mechanism, and comprises a supporting mechanism and a flapping mechanism arranged at opposite sides of the sheet-like mediums to be bundled.

7. The sheet-like medium stacking and bundling device according to claim 6, wherein the supporting mechanism is driven by a scissor-type mechanism to form a high position and a low position.

8. The sheet-like medium stacking and bundling device according to claim 6, wherein the flapping mechanism is driven by a crank-slider mechanism to perform reciprocating movement towards the supporting mechanism, so as to flap and flatten the sheet-like mediums.

9. A self-service apparatus, comprising a user operating portion, a sheet-like medium receiving portion, a sheet-like medium conveying portion and a sheet-like medium stacking and bundling device, wherein sheet-like medium stacking and bundling device comprises:

a sheet-like medium stacking mechanism, adapted to stack and tidy sheet-like mediums conveyed one by one;

a bundling mechanism, adapted to bundle a whole stack of stacked and tidied sheet-like mediums; and a clamping and conveying mechanism, adapted to clamp and convey the whole stack of sheet-like mediums stacked and tidied by the sheet-like medium stacking mechanism to the bundling mechanism to be bundled, and clamp a bundled sheet-like mediums bundle out of the bundling mechanism;

wherein the bundling mechanism comprises a paper tape loop-forming mechanism, a heat and pressure bonding mechanism and a paper tape cutting-off mechanism; the paper tape loop-forming mechanism comprises a guiding groove for guiding the paper tape, and a head and a tail of the guiding groove are connected to form a conveying loop; the guiding groove comprises a bottom portion, an opening corresponding to the bottom portion, and two corresponding groove side walls extending between the bottom portion and the opening, and the opening faces an inner side of the conveying loop; a paper tape inserting port and at least one paper tape conveying wheel are provided at the bottom portion of the guiding groove; the heat and pressure bonding mechanism and the paper tape cutting-off mechanism are located at the bottom portion of the guiding groove close to the paper tape inserting port; and a guiding member, having elasticity and parallel to the bottom portion of the guiding groove, is provided at an opening end of the groove side walls; and wherein the bundling mechanism further comprises a pressing mechanism, which is located at a side of the guiding groove opposite to the clamping and conveying mechanism, and comprises a pressing tongue and a pressing plate assembly arranged at opposite sides of sheet-like mediums to be bundled respectively; wherein the pressing tongue extends into the guiding groove, a bonding portion of the loop-forming paper tape is clamped between the pressing tongue and the heat and pressure bonding mechanism, and the pressing plate assembly is driven by a crank and connecting rod mechanism to move towards the pressing tongue to perform a pressing action or move away from the pressing tongue to perform a releasing action.

10. The self-service apparatus according to claim 9, wherein the guiding groove is of an annular track shape.

11. The self-service apparatus according to claim 10, wherein there are four paper tape conveying wheels respectively distributed at four corners of the guiding groove having the annular track shape.

12. The self-service apparatus according to claim 9, wherein the pressing plate assembly comprises a driving plate driven by a crank and connecting rod mechanism, and an elastic pressing plate is provided on a side of the driving plate facing the pressing tongue.

13. The self-service apparatus according to claim 12, wherein the pressing tongue is of a substantially triangular shape, the elastic pressing plate is of a substantially " 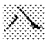 " shape, and the sheet-like mediums between the pressing tongue and the elastic pressing plate are pressed tightly by the pressing tongue and the elastic pressing plate to form deformation.

14. The self-service apparatus according to claim 9, wherein the bundling mechanism further comprises a flattening mechanism, which is located at a side of the guiding groove close to the clamping and conveying mechanism, and comprises a supporting mechanism and a flapping mechanism arranged at opposite sides of the sheet-like mediums to be bundled.

15. The self-service apparatus according to claim 14, wherein the supporting mechanism is driven by a scissor-type mechanism to form a high position and a low position.

16. The self-service apparatus according to claim 14, wherein the flapping mechanism is driven by a crank-slider mechanism to perform reciprocating movement towards the supporting mechanism, so as to flap and flatten the sheet-like mediums.

* * * * *